US005205338A

United States Patent [19]

Shimmell

[11] Patent Number: 5,205,338

[45] Date of Patent: Apr. 27, 1993

[54] CLOSED SHOT DIE CASTING

[75] Inventor: Dennis S. Shimmell, Hudsonville, Mich.

[73] Assignee: Nelson Metal Products Corporation, Grandville, Mich.

[21] Appl. No.: 805,033

[22] Filed: Dec. 11, 1991

[51] Int. Cl.[5] ..... B22D 13/00

[52] U.S. Cl. ..... 164/113; 164/316; 164/312

[58] Field of Search ..... 164/312, 313, 314, 315, 164/316, 317, 318, 113

[56] References Cited

U.S. PATENT DOCUMENTS

| | | | |
|---|---|---|---|
| 359,757 | 3/1887 | Wicks . | |
| 2,137,764 | 11/1938 | Wagner . | |
| 2,972,172 | 2/1961 | Federman . | |
| 3,019,495 | 2/1962 | Cornell . | |
| 3,292,218 | 12/1966 | Kozma | 164/315 |
| 3,646,990 | 3/1972 | Cross . | |
| 3,791,440 | 2/1974 | Cross . | |
| 3,810,505 | 5/1974 | Cross . | |
| 4,436,140 | 3/1984 | Ebisawa et al. . | |
| 4,505,318 | 3/1985 | Tokui et al. . | |
| 4,519,436 | 5/1985 | Ebisawa et al. . | |
| 4,614,463 | 9/1986 | Pluim, Jr. . | |
| 4,730,658 | 3/1988 | Nakano | 164/312 |

FOREIGN PATENT DOCUMENTS

| | | | |
|---|---|---|---|
| 0565457 | 3/1960 | Belgium | 164/314 |
| 0935147 | 10/1955 | Fed. Rep. of Germany | 164/314 |
| 0196159 | 11/1983 | Japan | 164/312 |
| 0102259 | 6/1985 | Japan | 164/113 |
| 0168897 | 10/1959 | Sweden | 164/312 |

*Primary Examiner*—Richard K. Seidel
*Assistant Examiner*—James Miner
*Attorney, Agent, or Firm*—Warner, Norcross & Judd

[57] ABSTRACT

A method and apparatus for closed shot die casting is disclosed in which a molten metal filling cylinder is provided intersecting a shot sleeve in fluid communication with a filling hole in the shot sleeve. Molten metal is introduced into the filling cylinder. The molten metal passes from the filling cylinder through the filling hole into the shot sleeve until the shot sleeve is completely filled with molten metal. The filling cylinder includes a piston-like, reciprocating internal valve which moves into position to seal off the filling hole. As a result, the shot sleeve is completely filled with molten metal and pressure-sealed prior to the advancement of the shot plunger.

27 Claims, 3 Drawing Sheets

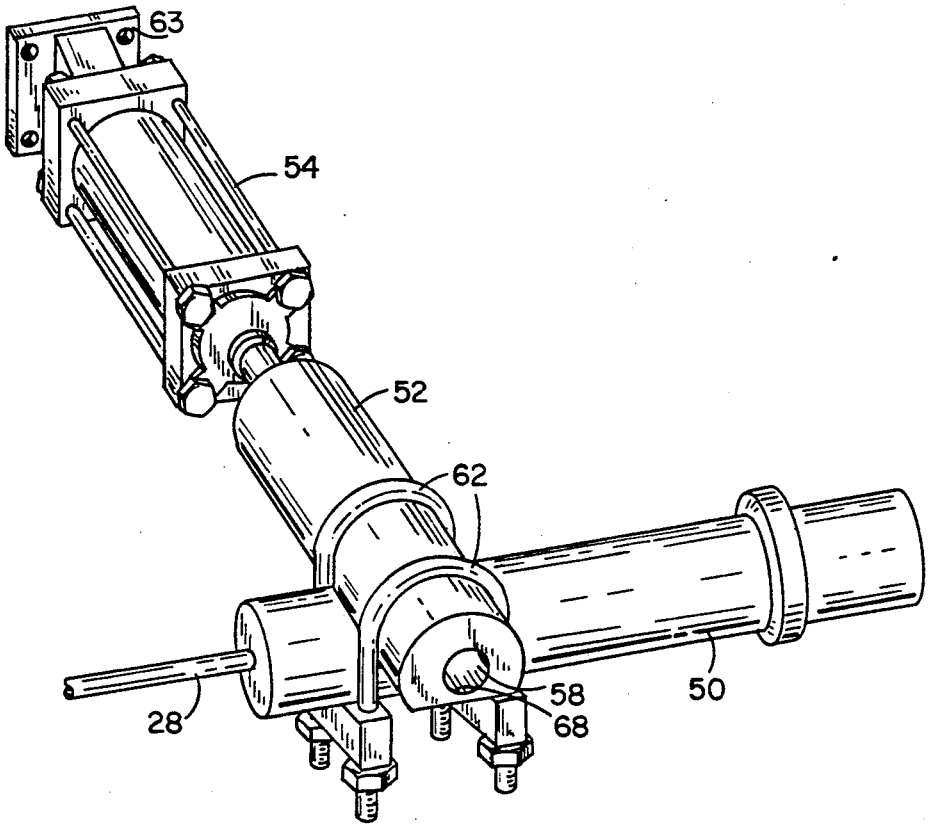
FIG. 4
FIG. 5A
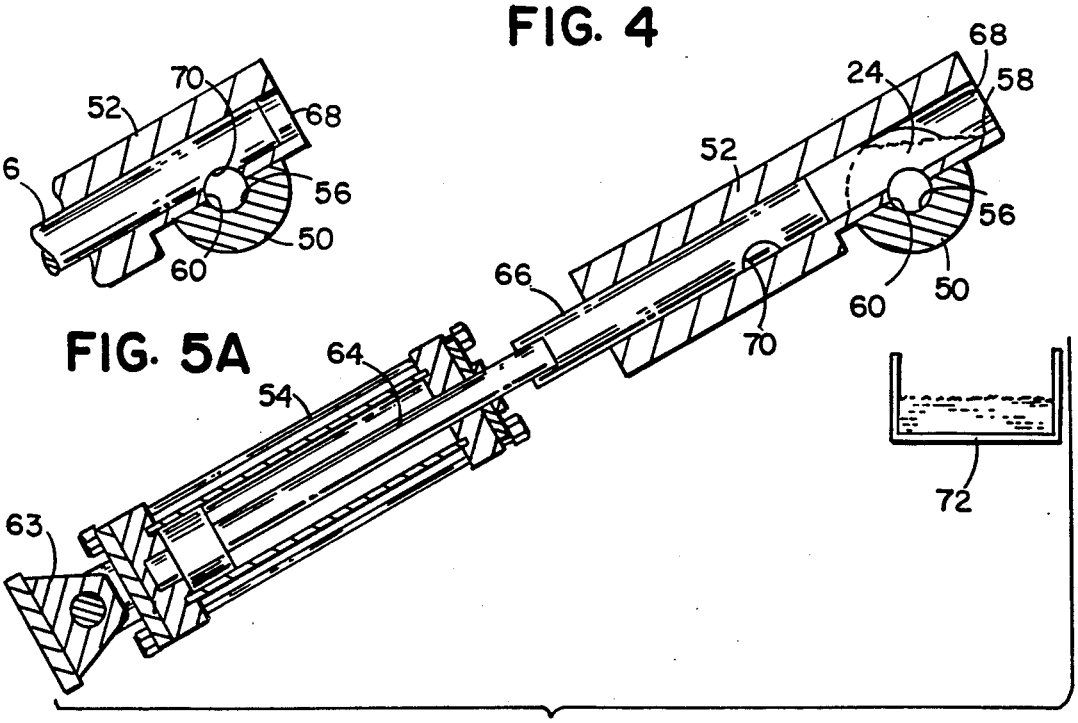
FIG. 5

CLOSED SHOT DIE CASTING

BACKGROUND OF THE INVENTION

1. Field of the Invention

The present invention relates to a method and apparatus for die casting molten material, and more particularly, to a method and apparatus for injecting a shot of molten material into the cavity of a die.

2. Description of the Related Art

Die casting is frequently used as a method for forming articles from molten material. The present invention will be described in terms of casting molten metal; however, it should be understood the invention may be practiced with other materials which may be cast from an initially liquid state. Typically, two or more die parts are provided such that, when brought together, they form a cavity which defines the shape of the article to be cast. Molten metal is introduced into the cavity and allowed to cool. If desired, the metal may be squeeze cast under high pressure to yield a heat treatable or weldable casting. The die parts are opened and the cast article is removed.

In the past, molten metal has been introduced into a die by means of a shot sleeve. FIG. 1 shows a horizontal die casting apparatus with a shot sleeve arrangement according to the prior art. The die 10 includes an ejector die 12 mounted to a movable platen 14 and a cover die 16 mounted to a stationary platen 18. Together, the dies 12 and 16 form a cavity 19 into which a shot of molten metal will be introduced. A cylindrical shot sleeve 20 is disposed passing axially through the stationary platen 18 and the cover die 16 in fluid communication with the cavity 19. The upper surface of the outer wall near the end of the shot sleeve 20 is penetrated by an open pouring or filling hole 22. Molten metal 24 is ladled through the filling hole 22 into the interior of the shot sleeve 20.

A plunger 26 seals off the outer end of the shot sleeve and reciprocates within the shot sleeve 20 to inject the molten metal into the die. The plunger 26 is connected axially to a plunger rod 28, crosshead adapter 30, and shot cylinder 32. The shot cylinder 32 is typically a hydraulic cylinder having a reciprocating shot cylinder rod 34 which causes the plunger 26 to advance toward the die 10 and withdraw therefrom. The outer end 36 of the shot cylinder rod is threaded to allow for adjustment of the shot size and stroke length.

Die casting methods and apparatus according to the prior art are subject to problems arising from the open filling hole 22 of the shot sleeve 20. The molten metal within the shot sleeve 20 is free to exit through the filling hole 22 until the plunger 26 advances past the filling hole. If the shot sleeve were entirely filled with molten metal, the beginning of plunger stroke would cause molten metal to spurt out of the filling hole 22. Therefore, as shown in FIG. 1, the shot sleeve 20 can only be partially filled with molten metal prior to the injection stroke of the plunger 26.

Since the shot sleeve 20 can only be partially filled with molten metal, the diameter of the sleeve must be enlarged to provide an air space as well as for the necessary volume of molten metal. This enlargement of the shot sleeve diameter reduces the mechanical advantage of the shot cylinder 32, making the apparatus less suitable for squeeze casting.

FIG. 2 shows the effect of the injection stroke of the plunger 26 on the molten metal 24. Since the molten metal does not completely fill the interior of the shot sleeve 20, a rolling, turbulent wave 40 of molten metal is created. Such turbulence in turn causes the formation of air bubbles 42 within the molten metal. The air bubbles ultimately cause unwanted porosity in the castings.

Accordingly, there is a heretofore unmet need for a die casting method and apparatus that prevents molten metal from exiting the filling hole of the shot sleeve, eliminates turbulence and air entrainment in the metal, enables increased injection pressures by improving the mechanical advantage of the plunger, and that is readily adaptable to existing die casting equipment.

SUMMARY OF THE INVENTION

The present invention satisfies the aforementioned need by providing a molten metal filling cylinder axially offset to the shot sleeve which overlaps and partially intersects the shot sleeve such that the bore of the filling cylinder is in fluid communication with the filling hole of the shot sleeve. Molten metal is introduced into the filling cylinder. The molten metal passes from the filling cylinder through the filling hole into the shot sleeve until the shot sleeve is completely filled with molten metal. The filling cylinder includes a piston-like, reciprocating internal slide valve which then moves into position to seal off the filling hole. As a result, the shot sleeve is completely filled with molten metal and pressure sealed prior to the advancement of the plunger.

Advantageously, the present invention eliminates air entrainment and resultant porosity. The diameter of the shot sleeve and the plunger are minimized so that mechanical advantage and shot pressure may be increased for squeeze casting. The invention is suitable for use with both horizontal and vertical die casting apparatus.

These and other objects, advantages, and features of the present invention will be more fully understood and appreciated by reference to the written specification and appended drawings.

BRIEF DESCRIPTION OF THE DRAWINGS

FIG. 4 is a perspective view of the intersecting shot sleeve and filling cylinder;

FIG. 5 is a sectional view taken substantially along the line 5—5 of FIG. 3;

FIG. 5*a* is a fragmentary, sectional view of the outer end of the filling cylinder similar to FIG. 5 but with the slide valve in the closed position.

DESCRIPTION OF THE PREFERRED EMBODIMENT

Figure 1:
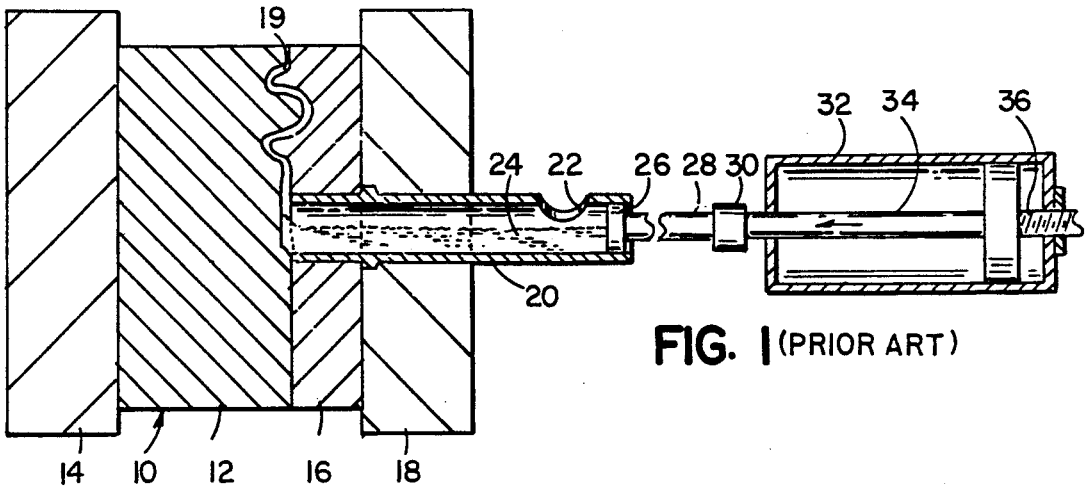
FIG. 1 (PRIOR ART)
FIG. 1 is a sectional, side elevational view of a die casting apparatus according to the prior art.
Figure 2:
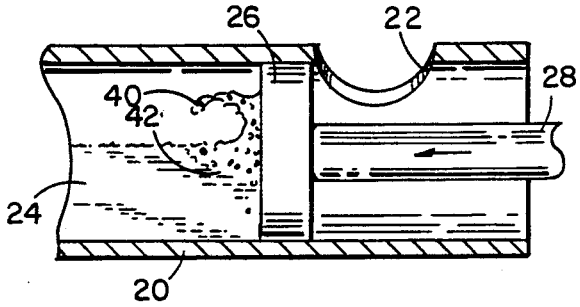
FIG. 2 (PRIOR ART)
FIG. 2 is a an enlarged, sectional elevational view of the prior art apparatus of FIG. 1 illustrating the effects of the advancement of the plunger in the shot sleeve partially filled with molten metal.
Figure 3:
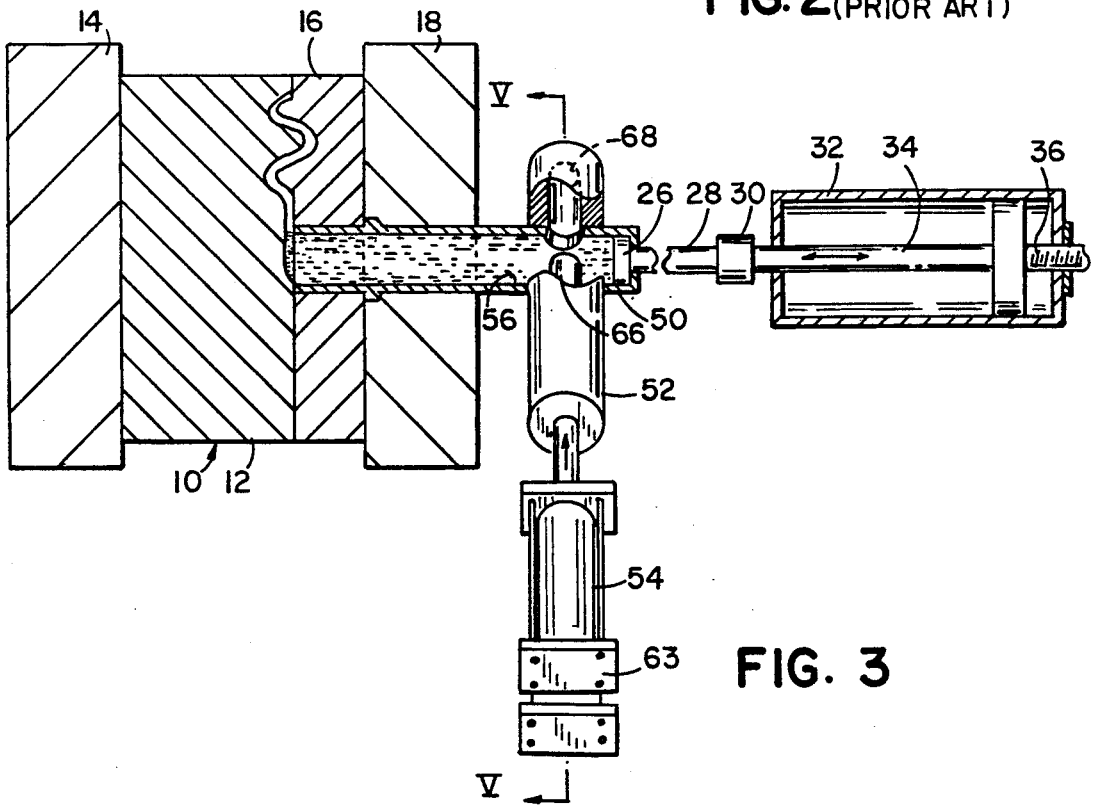
FIG. 3 is a side elevational view, with parts in vertical section of a die casting apparatus according to the principles of the invention.

By way of disclosing a preferred embodiment, and not by way of limitation, there is shown in FIG. 3 a closed shot die casting apparatus which includes in its general organization a die 10 having ejector and cover dies 12 and 16, movable and stationary platens 14 and 18, cavity 19, hydraulic shot cylinder 32, adjustment threads 36, rod 34, crosshead adapter 30, plunger rod 28, and plunger 26. Thus, the die, hydraulic shot cylinder, and plunger are substantially the same as described above with respect to the prior art shown in FIG. 1.

The apparatus of FIG. 3 further includes a shot sleeve 50, filling cylinder 52, and hydraulic cylinder 54. Shot sleeve 50 is similar to the shot sleeve 20 according to the prior art, but may be formed with a smaller diameter. Referring additionally to FIGS. 4 and 5, it may be seen that the shot sleeve 50 and filling cylinder 52 are so that a central extent of the filling cylinder overlaps the filling cylinder with their longitudinal axes perpendicularly offset to one another. The axis of the filling cylinder 52 crosses spaced apart above the axis of the shot sleeve 50. Thus, as best shown in FIG. 5, the spacing of the axes is such that the internal bore 56 of the shot sleeve and the internal bore 58 of the filling cylinder partially intersect. This intersection coincides with a filling hole 60 formed through the outer wall of the shot sleeve adjacent the outer end of the shot sleeve by which the shot sleeve and filling cylinder are in fluid communication. As shown in FIG. 4, the shot sleeve 50 and filling cylinder 52 are clamped together at their intersection in fluid-tight relationship by U-bolts 62.

Hydraulic cylinder 54 is mounted by a suitable base 63 and includes reciprocating rod 64. The outer end of rod 64 is coaxially coupled to a piston-like slide valve 66. Slide valve 66 thus moves reciprocatingly within the bore of the filling cylinder 52 actuated by hydraulic cylinder 52. In FIG. 5, slide valve 66 is shown in its retracted, or filling, position. In this position, the filling hole 60 is open and in fluid communication with the bore 58 of the filling cylinder.

When the slide valve is in the filling position and the shot plunger 28 withdrawn, molten metal is poured into the open outer end 68 of the filling cylinder 52. Pouring may be accomplished by ladling directly into the open end, through a funnel, or other suitable means. As best shown in FIG. 5, the filling cylinder 52 is tilted so that the molten metal runs down to the shot sleeve. The molten metal passes down the bore 58 of the filling cylinder, through the filling hole 60, and into the bore 56 of the shot sleeve 50. The shot sleeve is filled to overflowing such that the molten metal 24 covers the filling hole 60.

Hydraulic cylinder 54 is then actuated to extend the rod 64 and move the slide valve 66 toward the hole 60. When hydraulic cylinder 54 is fully extended, as shown in FIG. 5*a*, the slide valve 66 overlies the filling hole 60 and makes a fluid tight seal therewith prevent pressurized molten metal from exiting the filling hole when the plunger 26 is actuated. The sealing end of the slide valve 66 is formed with a recess 70 in the form of a segment of a cylindrical segment complementary in shape to the bore of the shot sleeve 50. The recess 70 permits the plunger 26 to reciprocate within the shot sleeve past the filling hole 60 without interference from the slide valve 66.

As shown in FIG. 5, a receptacle 72 may be provided beneath the open outer end 68 to catch any molten metal pushed out of the filling cylinder 52 by the slide valve 66.

An operating cycle of the apparatus of shown in FIGS. 3–5*a* is described as follows: Initially, die parts 12 and 16 are separated, and hydraulic cylinders 32 and 54 are extended. Die parts 12, 16 are brought together to form a cavity 19 in fluid communication with the inner end of the shot sleeve 50. Hydraulic cylinder 32 is retracted to withdraw the plunger 26 to the position shown in FIG. 3. Next, hydraulic cylinder 54 is retracted to withdraw the slide valve 66 to the position of FIG. 5. Molten metal is poured into the open end 68 of the filling cylinder until interior of the shot sleeve 50 is filled to overflowing with molten metal.

Next, hydraulic cylinder 54 is extended so that slide valve 66 moves into the position of FIG. 5*a* to seal off the filling hole 60 and contain the molten metal within the shot sleeve 50. Cylinder 32 is then actuated to forcibly extend the plunger 26 and drive the molten metal from the shot sleeve into the mold cavity. No air is entrained in the metal. High pressures may be developed in the metal for squeeze casting. Finally, the die parts are separated and the casting is removed.

Figure 6:
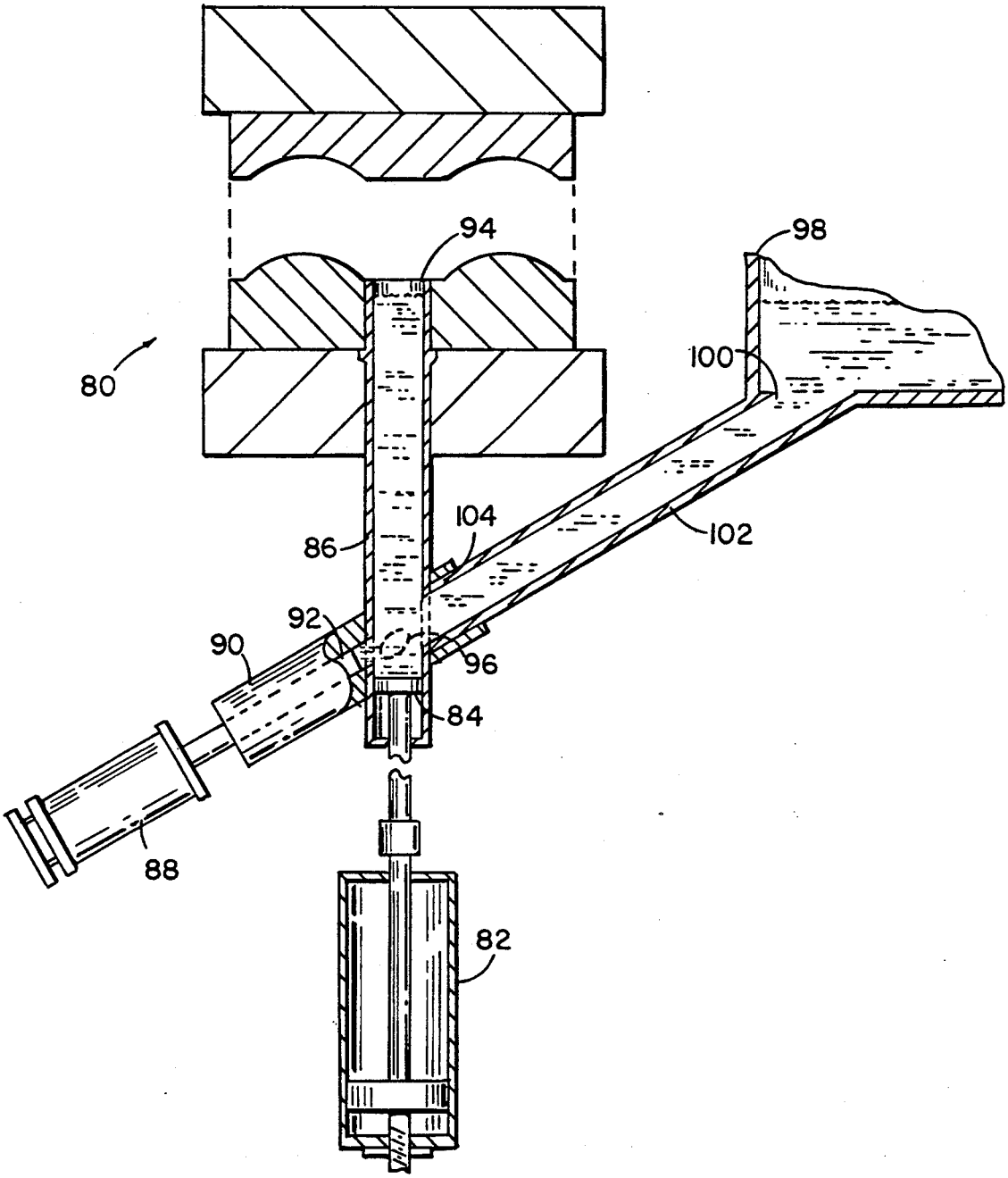
FIG. 6 is a side elevational view, with parts in vertical section of a vertical die casting apparatus according to an alternate embodiment of the invention.

An alternate embodiment of the invention in a vertical die casting system is show in FIG. 6. In a manner similar to the embodiment of FIG. 3, the vertical system includes a die 80, a hydraulic shot cylinder 82, plunger 84, shot sleeve 86, hydraulic cylinder 88, filling cylinder 90, and slide valve 92. The hydraulic cylinder 82, plunger 84, and shot sleeve 80 are coaxial and vertically oriented with the upper end opening 94 of the shot sleeve in fluid communication with the cavity of the die.

As with the embodiment of FIG. 3, filling cylinder 90 is situated with its axis angularly offset to the shot sleeve axis and spaced apart from the shot sleeve axis where the axes cross. Filling cylinder 92 overlaps and partially intersects the shot sleeve 86 such that the internal bores of both are in fluid communication through a filling opening or hole 96.

FIG. 6 further illustrates an alternate means for introducing molten metal into the filling cylinder which eliminates the need for ladling and seals the filling system from the atmosphere. The axis of the filling cylinder 90 is tilted upwardly toward a reservoir 98 of molten metal. The lower extent of the reservoir 98 is formed with an opening 100 which leads to a downwardly sloping passage 102. The lower end of the passage 102 is connected to the upper end opening 104 of the filling cylinder 90. Thus, when slide valve 92 is withdrawn, molten metal flows by gravity from the reservoir 98 down the passage 102, into the filling cylinder, through filling hole 96 and into the shot sleeve 86. The molten metal fills the shot sleeve by rising until it is at the same surface level as the molten metal in the reservoir 98.

Once the shot sleeve is filled, hydraulic cylinder 88 extends the slide valve 92 to seal off the filling hole 96. Slide valve 92 is formed with a recess (not shown) similarly to the recess 70 shown in FIG. 5*a* to allow the plunger 84 to pass the filling hole 96 without interference.

Thus, it may be seen that the invention is easily adaptable to convert a conventional die cast apparatus to squeeze cast apparatus in which relatively high pressures are developed in the injected molten metal. Conventional intensification systems may be used with the invention. Existing shot stroke adjustment is used to adjust shot size. The invention is suitable for casting steel, aluminum, magnesium, as well as other metallic and nonmetallic materials. The movements of the plunger and the slide valve keep the pouring paths clear.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A die casting apparatus comprising:

a die having a die cavity;

a shot sleeve having an axial internal bore in fluid communication with said die cavity and a filling hole in fluid communication with said internal bore;

a plunger disposed in said internal bore of said shot sleeve for reciprocating axial movement therein;

a filling cylinder having an axial internal bore disposed with its axis angularly offset with respect to the axis of said shot sleeve and spaced apart from the axis of said shot sleeve, a central extent of said filling cylinder overlapping and partially intersecting said shot sleeve at said filling hole such that both of said internal bores are in overlapping fluid communication with each other through said filling hole, said filling cylinder further having an opening for the introduction of molten material into said internal bore of said filling cylinder;

a slide valve means disposed in said internal bore of said filling cylinder for reciprocating axial movement therein between a first position in which said filling hole is open to allow molten material to flow from said internal bore of said filling cylinder through said filling hole into the internal bore of said shot sleeve and a second position in which said slide valve overlyingly seals said filling hole during axial movement of said plunger.

2. The die casting apparatus of claim 1 wherein said shot sleeve is disposed axially horizontally.

3. The die casting apparatus of claim 2 wherein said filling cylinder is disposed axially perpendicularly to the axis of said shot sleeve.

4. The die casting apparatus of claim 3 wherein said filling cylinder is disposed axially sloping such that molten material introduced into said opening flows downwardly through said internal bore of said filling cylinder, through said filling hole, and into said internal bore of said shot sleeve.

5. The die casting apparatus of claim 1 wherein said shot sleeve is disposed axially vertically.

6. The die casting apparatus of claim 5 wherein said filling cylinder is disposed axially sloping such that such that molten material introduced into said opening flows downwardly through said internal bore of said filling cylinder, through said filling hole, and into said internal bore of said shot sleeve.

7. The die casting apparatus of claim 6 further comprising a reservoir for molten material, a passage interconnecting said reservoir and said opening of said filling cylinder, whereby molten material flows by gravity from said reservoir through said passage and said opening.

8. The die casting apparatus of claim 1 wherein said slide valve is formed with a recess having a shape complementary to the shape of said internal bore of said shot sleeve.

9. A die casting apparatus comprising:

a die having a die cavity;

a shot sleeve having an outer wall with an axial internal bore and axially spaced apart ends, one end of said internal bore in fluid communication with said die cavity, said shot sleeve further having a filling hole formed through said outer wall adjacent the other end;

a plunger disposed in said internal bore of said shot sleeve for reciprocating axial movement therein past said filling hole to inject molten material in said shot sleeve into said die cavity;

a filling cylinder having an axial internal bore disposed with its axis angularly offset across the axis of said shot sleeve and spaced apart from the axis of said shot sleeve, a central extent of said filling cylinder overlapping and partially intersecting said shot sleeve at said filling opening such that the internal bores of the shot sleeve and of the filling cylinders are in fluid communication through said filling opening, said filling cylinder having an opening for the introduction of molten material into said internal bore of said filling cylinder;

a slide valve means disposed in said internal bore of said filling cylinder for reciprocating axial movement therein between a first position in which said slide valve is withdrawn from said filling hole to allow molten material to flow from said internal bore of said filling cylinder through said filling hole into the internal bore of said shot sleeve and a second position in which said slide valve overlyingly seals said filling hole to prevent molten material from exiting said internal bore of said shot sleeve as said plunger moves past said filling hole to inject the molten material into said die cavity.

10. The die casting apparatus of claim 9 wherein said shot sleeve is disposed axially horizontally.

11. The die casting apparatus of claim 10 wherein said filling cylinder is disposed axially perpendicularly to the axis of said shot sleeve.

12. The die casting apparatus of claim 11 wherein said filling cylinder is disposed axially sloping such that molten material introduced into said opening flows downwardly through said internal bore of said filling cylinder, through said filling hole, and into said internal bore of said shot sleeve.

13. The die casting apparatus of claim 9 wherein said shot sleeve is disposed axially vertically.

14. The die casting apparatus of claim 13 wherein said filling cylinder is disposed axially sloping such that such that molten material introduced into said opening flows downwardly through said internal bore of said filling cylinder, through said filling hole, and into said internal bore of said shot sleeve.

15. The die casting apparatus of claim 14 further comprising a reservoir for molten material, a passage interconnecting said reservoir and said opening of said filling cylinder, whereby molten material flows by gravity from said reservoir through said passage and said opening.

16. The die casting apparatus of claim 9 wherein said slide valve is formed with a recess having a shape complementary to the shape of said internal bore of said shot sleeve.

17. A method for closed shot die casting comprising:

providing a shot sleeve having an axial internal bore in fluid communication with the cavity of a die;

providing a filling cylinder axially angularly offset with respect to the axis of said shot sleeve and spaced apart from the axis of said shot sleeve with a central extent of the filling cylinder overlapping and partially intersecting the shot sleeve at a filling hole, the filling cylinder having an internal bore overlapping and partially intersecting the internal bore of the shot sleeve in fluid communication therewith through the filling hole;

introducing molten material into the filling cylinder;

allowing the molten material to flow from the filling cylinder through the filling hole into the internal bore of the shot sleeve to completely fill the internal bore of the shot sleeve with molten material;

advancing a slide valve within the internal bore of the filling cylinder to overlyingly seal the filling hole; and advancing a plunger within the internal bore of the shot sleeve past the filling hole to inject the molten material into the cavity of the die.

18. A metal delivery system for a die casting apparatus comprising:

a shot sleeve having an axial internal bore and a filling hole in fluid communication with said internal bore;

a filling cylinder having an axial internal bore disposed with its axis angularly offset with respect to the axis of said shot sleeve, said filling cylinder at least partially intersecting said shot sleeve at an intersection, said filling hole formed at said intersection such that both of said internal bores are in fluid communication with each other through said filling hole, and such that molten material in said filling cylinder may pass through said filling hole into said shot sleeve and completely fill said shot sleeve, said filling cylinder further having an opening for the introduction of molten material into said internal bore of said filling cylinder;

a slide valve disposed in said internal bore of said filling cylinder for reciprocating axial movement therein between a first position in which said filling hole is open to allow molten material to flow from said internal bore of said filling cylinder through said filling hole into the internal bore of said shot sleeve to completely fill said shot sleeve and a second position in which said slide valve is disposed at said filling hole and prevents molten material from flowing between said internal bore of said filling cylinder and said internal bore of said shot sleeve through said filling hole;

a plunger disposed in said internal bore of said shot sleeve for reciprocating axial movement therein through said intersection;

said slide valve formed with a void disposed in alignment with said intersection when said slide valve is in said second position, said void allowing said plunger to pass through said intersection unobstructed.

19. The die casting apparatus of claim 18 wherein said shot sleeve is disposed axially horizontally.

20. The die casting apparatus of claim 19 wherein said filling cylinder is disposed axially perpendicularly to the axis of said shot sleeve.

21. The die casting apparatus of claim 20 wherein said filling cylinder is disposed axially sloping such that molten material introduced into said opening flows downwardly through said internal bore of said filling cylinder, through said filling hole, and into said internal bore of said shot sleeve.

22. The die casting apparatus of claim 18 wherein said shot sleeve is disposed axially vertically.

23. The die casting apparatus of claim 22 wherein said filling cylinder is disposed axially sloping such that such that molten material introduced into said opening flows downwardly through said internal bore of said filling cylinder, through said filling hole, and into said internal bore of said shot sleeve.

24. The die casting apparatus of claim 23 further comprising a reservoir for molten material, a passage interconnecting said reservoir and said opening of said filling cylinder, whereby molten material flows by gravity from said reservoir through said passage and said opening.

25. The die casting apparatus of claim 18 wherein the axis of said shot sleeve is spaced apart from the axis of said shot sleeve at said intersection.

26. The die casting apparatus of claim 18 wherein said filling hole is disposed between said opening and said slide valve when said slide valve is in its first position.

27. An improved metal-delivery system for a die-casting apparatus, said system comprising:

a shot sleeve defining an elongated shot bore having an axis;

a shot plunger reciprocable within said shot bore;

a filling cylinder defining an elongated filling bore having an axis, said shot bore and said filling bore at least partially intersecting one another so as to be in fluid communication with one another, the axes of said shot bore and said filling bore being nonparallel;

a slide valve reciprocable within said filling bore, said slide valve being operable between a filling position permitting molten metal to flow from said filling bore to said shot bore and a shot position prohibiting molten metal from flowing from said filling bore to said shot bore, said slide valve defining a passageway aligned with said shot bore when said slide valve is in said shot position and dimensioned to permit said shot plunger to pass therethrough, whereby said shot plunger can reciprocate past said slide valve in said shot position.

* * * * *